United States Patent [19]

Van Note

[11] Patent Number: 4,488,369

[45] Date of Patent: Dec. 18, 1984

[54] MARKSMANSHIP TRAINING APPARATUS

[76] Inventor: Todd Van Note, Rte. #2, Box 326, Frisco, Tex. 75034

[21] Appl. No.: 498,067

[22] Filed: May 25, 1983

[51] Int. Cl.[3] ..... F41C 27/00; F41G 1/34

[52] U.S. Cl. ..... 42/1 A; 362/110

[58] Field of Search ..... 42/1 A, 110; 362/111; 434/21

[56] References Cited

U.S. PATENT DOCUMENTS

| | | | |
|---|---|---|---|
| 1,149,705 | 8/1915 | Ward | 42/1 A |
| 1,215,171 | 2/1917 | Lewis | 42/1 A |
| 4,048,489 | 9/1977 | Giannetti | 42/1 A |

*Primary Examiner*—Charles T. Jordan

*Attorney, Agent, or Firm*—Kanz, Scherback & Timmons

[57] ABSTRACT

Disclosed is apparatus for removeably mounting on small firearms to assist in marksmanship training. The apparatus includes a lamp and lamp firing circuit activated by a switch moveable between first and second positions by an elastic band coupled between the switch and the hammer of the firearm. The circuit is arranged to charge a capacitor when the hammer is cocked and uses the energy stored in the capacitor to switch a transistor to temporarily connect the lamp to a battery when the firearm is fired.

4 Claims, 4 Drawing Figures

MARKSMANSHIP TRAINING APPARATUS

This invention relates to apparatus for marksmanship training. More particularly, it relates to apparatus for removeably mounting on small firearms and the like to project a beam of light onto the spot where the firearm is aimed at the time the firing mechanism of the firearm is activated. The training apparatus is removeably secured to the firearm and is adapted to be used in conjunction with the firearm so that the user may practice marksmanship training without discharging live ammunition.

In firearms marksmanship, as with any other activity requiring physical dexterity and hand-to-eye coordination, repetitive practice is required to perfect technique. It is also well-known that learning is significantly enhanced when the result of the manipulative actions taken are immediately visually perceptible. Accordingly, proficiency in the use of firearms can only be acquired by actual physical use of the weapon.

Many of the individual physical movements involved in use of a firearm, of course, are learned by repetition practice of the movements, the operator thereby becoming accustomed to the "feel" or "balance" of the weapon during properly coordinated movements. Unfortunately, to practice use of a firearm under totally realistic conditions, live ammunition must be discharged at a target. Use of live ammunition, however, is expensive, noisy and incurs certain risks. Furthermore, practice using live ammunition must be limited to carefully controlled conditions which obviously limit the amount of time one may commit to actual practice. For these and other reasons, it is particularly desirable to provide means for practicing weapons use under simulated conditions which do not involve the actual discharge of live ammunition.

Various prior art devices have been contrived, some of which have met with a modicum of success, which substitute the emission of light for the discharge of live ammunition to train one in the aiming and use of firearms. Unfortunately, all of the prior art devices suffer from one or more major limitations. For example, many such devices are bulky, unwieldy and otherwise difficult to use. Many require major modification of the firearm to accept the training device and render the firearm (at least temporarily) inoperative to fire live ammunition. Most require a direct linkage to the trigger and/or otherwise interfere with the feel or balance of the weapon so that use thereof does not properly condition the user for the feel or balance of the same weapon when live ammunition is used. Most such devices, however, suffer an even more serious limitation in that they are adaptable to and useable only in connection with a single weapon design. Thus the training device must take substantially different forms for use on or in connection with firearms of only slightly different design. It is therefore apparent that a training device which obivates the problems of the prior art is highly desirable.

In accordance with the present invention, a training apparatus is provided which is miniature, lightweight and very compact and which is readily adaptable for use on or in connection with a wide variety of firearms. The apparatus is readily mountably on and detachable from the weapon in a matter of minutes and, more importantly, does not render the weapon inoperative even when mounted thereon. Furthermore, the mechanism for activating the training apparatus of the invention does not attach to or in any manner affect the trigger of the firearm. Instead, the training apparatus is activated by the firearm hammer. Accordingly, the training apparatus can in no way affect trigger feel or activation and, more importantly, is actuated precisely in unison and simultaneously with activation of the firing pin. Thus the optical signal generated by the training device precisely duplicates the timing of a projectile fired by the weapon. Other features and advantages of the invention will become more readily apparent from the following detailed description taken in connection with the appended claims and attached drawings in which:

The following disclosure is offered for public dissemination in return for grant of a patent. Although it is sufficiently detailed to provide full understanding of the principles of the invention, this disclosure is not intended to prejudice the purpose of a patent which is to protect each new inventive concept therein no matter how others may later disguise it by variations in form, additions or further improvements.

For convenience and clarity of illustration, the invention is described herein with particular reference to mounting and use thereof in connection with a standard revolver. It will be appreciated, however, that the invention is not so limited. Instead, the apparatus is adaptable for use in connection with a wide variety of weapons including handguns and rifles. It is only necessary that the weapon have an exposed moveable component of the firing mechanism that moves in conjunction with the firing pin and relative to the portion of the weapon upon which the training apparatus is mounted. Accordingly, the term "hammer" as used herein is intended to encompass and include any such exposed moveable portion of the firing mechanism which moves simultaneously with and in the same direction as the firing pin.

Figure 1:
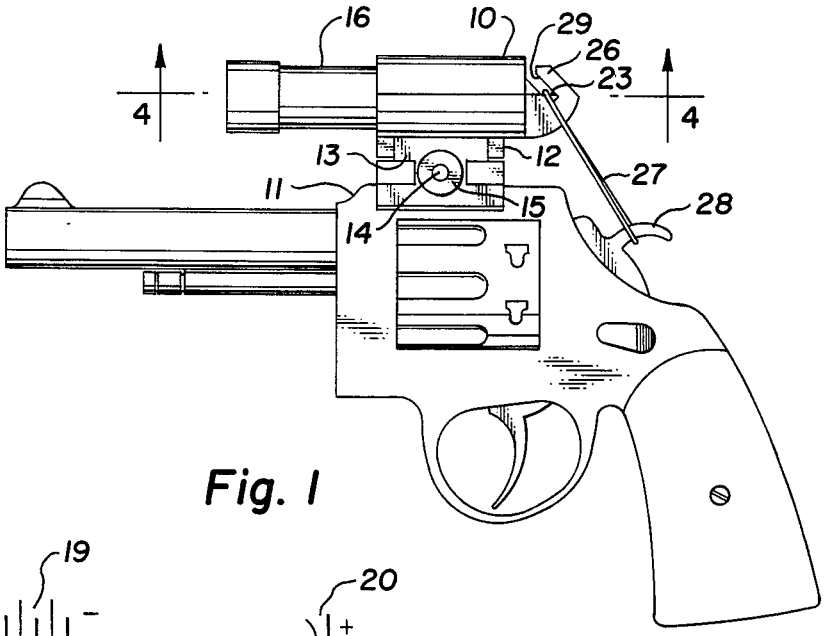
FIG. 1 is an elevational view illustrating the preferred embodiment of the invention mounted on a revolver.

Referring now to the drawings, the preferred embodiment of the invention is shown mounted on a revolver of standard configuration. The apparatus illustrated comprises a housing or frame 10 adapted for detachably mounting directly on the frame 11 of the revolver or other firearm. In the preferred embodiment as illustrated in FIG. 1, the frame 10 is secured to frame 11 of the revolver by means of a caliper or vice-like mounting structure comprising a member 12 rigidly secured to the underside of frame 10 and mating with one side of the frame 11 of the revolver and a second member 13 transversely slideably or hingeably mounted in or otherwise cooperating with first member 12 and mating with the opposite side of frame 11 of the revolver. A threaded stud 14 projecting from first member 12 through second member 13 mates with a knurled nut 15 or wing nut or the like. It will thus be observed that the frame 10 may be rigidly secured directly to the frame 11 of the revolver by expanding first member 12 and second member 13 sufficiently to permit said members to nest snugly against the sides of frame 11 and align therewith. The nut 15 is then tightened to rigidly secure the frame 10 to the frame 11 of the revolver.

In the preferred embodiment, first and second members 12, 13 are sufficiently elongated in the vertical direction to space the frame 10 above the frame 11 of the revolver so as not to interfere with normal use of visual sighting means mounted on the frame and barrel of the firearm. Accordingly, the user may visually aim the firearm in the normal manner by use of the conventional sights and without interference by the training apparatus of the invention.

A hollow barrel 16 projects laterally from frame 10 parallel with the barrel of the firearm and communicates with the hollow interior of the frame 10. A lamp 17 is mounted within the hollow interior of frame 10 so that, when activated, light emitted thereby will be directed through barrel 16. A mirror (not shown) may be mounted within the frame 10 on the side of the lamp 17 opposite the barrel 16 to further concentrate and direct light emitted by the lamp 17 through the barrel 16.

A lens 18 is mounted within the barrel 16 near the end thereof opposite lamp 17 and is adapted to project light emitted by the lamp 17 along a path parallel with the barrel of the firearm and in the direction in which the barrel of the firearm is aimed. If desired, the relationship between the lens 18 and lamp 17 may be variable so as to focus the emitted light to a spot at approximately the distance of the target. When used in connection with a handgun, it is desired that the diameter of the light spot projected onto the target at a distance of about fifteen to about thirty feet be approximately one inch in diameter. These dimensions and variables, however, may be varied as desired.

Figure 2:
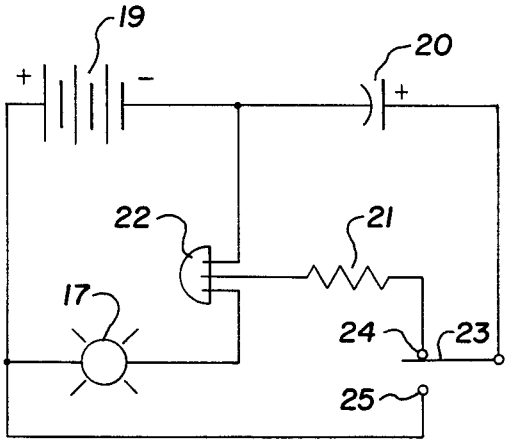
FIG. 2 is a schematic illustration of the preferred embodiment of the charging and firing circuit for producing the optical signal of the invention.
Figure 3:
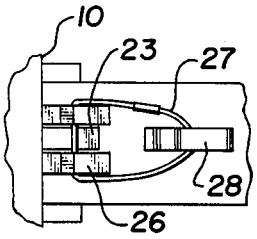
FIG. 3 is fragmentary top view of the arrangement of FIG. 1 illustrating the switch and hammer linkage in the relaxed position.
Figure 4:
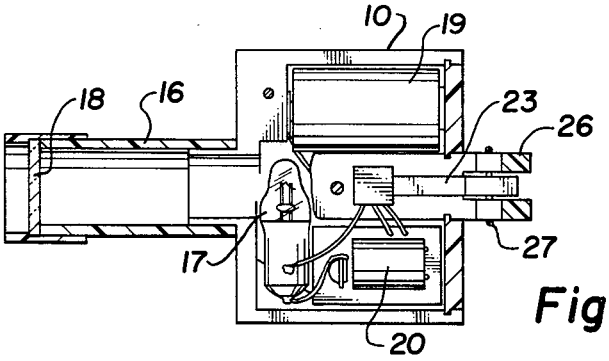
FIG. 4 is a sectional view of the apparatus of FIG. 1 taken through line 4—4 illustrating placement of components in the preferred embodiment of the invention.

An electrical schematic for the preferred circuit for firing the lamp 17 is illustrated in FIG. 2. The electrical schematic illustrated comprises a charging circuit and a discharging circuit for capacitor 20 and an activation circuit for lamp 17. As described hereinafter, when the hammer 28 is cocked to arm the device for firing, switch connector blade 23 is moved downwardly from a first position to a second position where it is in electrical contact with contact 25, thereby completing a series charging circuit of battery 19 and capacitor 20. Capacitor 20 is thus charged to the voltage of battery 19.

In the preferred embodiment, transistor 22 is an NPN transistor connected in the circuit in a common emitter configuration. The emitter is connected to the lead between the negative terminal of battery 19 and the capacitor 20. The base is connected to one end of resistor 21 and the collector is connected to one side of lamp 17. Without a bias voltage applied to the base of transistor 22, the transistor 22 is cut off and current does not flow through lamp 17 from battery 19.

When the trigger is pulled and the hammer 28 released to fire the firearm, the switch connector blade 23 moves upwardly from the second position to the first position where it is in electrical contact with contact 24, thereby completing the discharge circuit for capacitor 20. The capacitor is thus discharged through resistor 21 and transistor 22.

The voltage of capacitor 20 biases transistor 22 out of its cut off stage and allows transistor 22 to conduct and complete the activation circuit for lamp 17. While transistor 22 is conducting, the current from battery 19 flows through transistor 22 and lamp 17, thereby causing lamp 17 to emit light. The voltage on capacitor 20 decreases as the capacitor discharges, thus a point will rapidly be reached where the bias voltage on the base of transistor 22 will no longer be of sufficiently high value to sustain conduction through transistor 22. Transistor 22 will then cut off and lamp 17 will go out. The time the light 17 remains on depends primarily on the voltage level to which capacitor 20 is charged and the value of resistor 21.

It will thus be observed that transistor 22 serves as an on/off switch connecting the lamp 17 directly across the terminals of battery 19. The period for which lamp 17 is illuminated is determined, of course, by the value of resistor 21, the cut-off voltage of transistor 22, the voltage potential of battery 19 and the capacitance of capacitor 20. The period of illumination may thus be selected as desired by selecting the appropriate components. This arrangement, however, assures that relatively constant voltage and current are applied to the lamp 17 during the period transistor 22 is conducting. Accordingly, the light output of the lamp will be relatively constant during the entire period and does not diminish with voltage decay of the capacitor. This circuit thus provides at least two unique advantages. Since the lamp cannot be illuminated unless the transistor 22 is in a conducting state, no external switch is required to activate the circuit, thus parts costs are reduced and accidental discharge of the battery cannot occur. Nevertheless, as soon as the hammer 28 is cocked, the capacitor is charged for firing the lamp. Furthermore, the light output of lamp 17 is relatively constant for a finite period. Thus, instead of an instantaneous flash or a flash of decaying brilliance, the user observes an illumination of relatively constant intensity for a finite period of time. Thus the exact point at which the weapon is aimed at the time the firing mechanism is activated is clearly discernible.

The switch connector blade 23 projects through an aperture in frame 10 at the end thereof opposite barrel 16 and into a cradle 26 extending laterally from the frame 10. An elastic band 27 nested within slot 29 in cradle 26 connects switch connector blade 23 to the hammer 28 of the firearm. The tension on elastic band 27 may be adjusted by adjusting the length of the band and/or moving the frame 10 forward or aft on frame 11 of the revolver so that the elastic band 27 is relaxed when the hammer 28 is in the forward or fired position. Accordingly, since switch connector blade 23 is normally urged toward the first position and in electrical communication with contact 24, the charging circuit is open and the capacitor 20 is discharged. However, when the hammer 28 is cocked to arm the device for firing, it moves rearwardly with respect to the frame 10 thus moving switch connector blade 23 downwardly into electrical communication with contact 25. In this configuration the charging circuit is activated and capacitor 20 is charged by the battery 19. In order to avoid applying excessive pressure to the switch connector blade 23, the depth of slot 29 is limited. Thus, when sufficient pressure is applied to switch connector blade 23 by elastic band 27 to move the switch connector blade into electrical communication with contact 25, the band 27 rests at the bottom of the slot 29. Accordingly, additional tension applied to elastic band 27 by further movement of hammer 28 only serves to lengthen the band 27 without applying undue pressure to the switch connector blade 23.

Since the band 27 is elastic and connected with the hammer 28, and since movement of the switch connector blade 23 is limited by the depth of slot 29 in the cradle 26, critical alignment and critical mechanical coupling between the hammer 28 and switch blade 23 is avoided. Upon firing the weapon, the hammer is released to move forward, thus releasing tension on the elastic band 27. When the tension on the elastic band 27 is released, switch connector blade 23 returns to the first position in electrical communication with contact 24, thus firing the lamp 17.

It will be observed that the apparatus as described hereinabove can be readily fabricated using a minimum of relatively inexpensive components and may be readily adapted for use in connection with a wide variety of weapons. Since the activating linkage between the training device and the weapon itself comprises only an elastic band under tension, critical adjustment between the training device and the weapon is eliminated. Furthermore, since the device is fired by releasing the tension on the elastic band 27 and the band is connected to the hammer instead of the trigger, the training device cannot affect trigger movement or the feel of the trigger mechanism. Thus the invention provides various advantages not available in prior art training devices.

From the foregoing it will be observed that the principles of the invention may be practiced and embodied in various forms to provide efficient, simple, inexpensive and effective means for use in connection with a firearm to practice aiming and use thereof. It is to be understood, therefore, that while the invention has been described with particular reference to specific embodiments thereof, the forms of the invention shown and described in detail are to be taken as preferred embodiments of same. Various changes and modifications may be resorted to without departing from the spirit and scope of the invention as defined by the appended claims.

I claim:

1. Training apparatus for use in connection with a firearm having a hammer and a barrel comprising:

(a) frame means adapted for removeably mounting on said firearm;

(b) barrel means projecting from said frame means and aligned parallel with the barrel of said firearm;

(c) lamp means mounted within said frame means which, when activated, directs light through said barrel means projecting from said frame means;

(d) lens means mounted within said barrel means and adapted to project light emitted by said lamp means along a path parallel with the barrel of said firearm;

(e) circuit means for activating said lamp means mounted in said frame means including switch means normally urged to a first position and moveable to a second position; and (f) elastic switch activating means connectable between said switch means and the hammer of said firearm to move said switch means from said first position to said second position when said hammer is cocked for firing and to release said switch means to return to said first position when said hammer is released for firing said firearm.

2. Apparatus as defined in claim 1 wherein said circuit means comprises:

(a) said lamp means;

(b) said switch means;

(c) a storage battery;

(d) a capacitor connected across the terminals of said battery when said switch means is in said second position;

(e) lamp activating switching means electronically switchable between a conducting state and a non-conducting state arranged to connect said lamp means across the terminals of said storage battery only when in said conducting state; and (f) means for applying energy stored in said capacitor to said lamp activating switching means and thereby switch said lamp activating switching means to said conducting state for a finite period of time after said switching means is returned to said first position.

3. Apparatus as defined in claim 2 wherein said lamp activating switching means is an NPN transistor.

4. Apparatus as defined in claim 1 including cradle means projecting from said frame means surrounding said switch means to permit said switch means to alternatively move between said first position and said second position, said cradle means having a transverse slot therein for receiving said elastic switch activating means and permit said elastic switch activating means to move said switch means from said first position to said second position.

* * * * *